US012054331B2

(12) United States Patent
Shim et al.

(10) Patent No.: US 12,054,331 B2
(45) Date of Patent: Aug. 6, 2024

(54) PUSH-TYPE REFILLABLE COSMETIC CONTAINER

(71) Applicant: NEST-FILLER PKG CO., LTD., Bucheon-si (KR)

(72) Inventors: Yoon Seog Shim, Bucheon-si (KR); Sung Hwan Kang, Gwangmyeong-si (KR)

(73) Assignee: NEST-FILLER PKG CO., LTD., Bucheon-si (KR)

( * ) Notice: Subject to any disclaimer, the term of this patent is extended or adjusted under 35 U.S.C. 154(b) by 0 days.

(21) Appl. No.: 17/766,608

(22) PCT Filed: Oct. 21, 2020

(86) PCT No.: PCT/KR2020/014423
§ 371 (c)(1),
(2) Date: Apr. 5, 2022

(87) PCT Pub. No.: WO2021/235618
PCT Pub. Date: Nov. 25, 2021

(65) Prior Publication Data

US 2024/0109708 A1 Apr. 4, 2024

(30) Foreign Application Priority Data

May 20, 2020 (KR) ..... 10-2020-0060270

(51) Int. Cl.
*B65D 77/04* (2006.01)
*A45D 40/00* (2006.01)

(52) U.S. Cl.
CPC ..... *B65D 77/0486* (2013.01); *A45D 40/0068* (2013.01); *A45D 2200/05* (2013.01); *B65D 2577/041* (2013.01)

(58) Field of Classification Search
CPC ..... B65D 77/0486; B65D 77/0493; B65D 2577/041; A45D 40/0068
(Continued)

(56) References Cited

U.S. PATENT DOCUMENTS

2013/0105476 A1 5/2013 Hammer et al.

FOREIGN PATENT DOCUMENTS

JP 2011-245074 12/2011
JP 2013-028399 2/2013
(Continued)

OTHER PUBLICATIONS

JP 2011-245074 English translation (Year: 2011).*
English translation.*

*Primary Examiner* — Jeffrey R Allen
(74) *Attorney, Agent, or Firm* — LEX IP MEISTER, PLLC

(57) ABSTRACT

Proposed is a refillable cosmetic container to which an inner container containing cosmetic contents is coupled. The inner container is inserted into an outer container so that a coupling part (22) provided on the upper portion of the inner container (20) is coupled to the stepped part (12) provided on the upper portion of the outer container (10), and a press groove (15) is formed on the first side of the stepped part of the outer container to be recessed downward, so the inner container can be simply separated by the gap formed as the upper portion of the second side of the inner container is lifted upward from the outer container by downwardly pushing the press groove of the outer container on the first side of the upper portion of the inner container, thus making it convenient to refill and use the inner container.

4 Claims, 6 Drawing Sheets

(58) Field of Classification Search
USPC ..... 220/23.97, 23.89, 23.87, 23.4
See application file for complete search history.

(56) References Cited

FOREIGN PATENT DOCUMENTS

| | | |
|---|---|---|
| JP | 2016-193741 | 11/2016 |
| KR | 10-1517595 | 5/2015 |
| KR | 10-2109199 | 5/2020 |

* cited by examiner

PUSH-TYPE REFILLABLE COSMETIC CONTAINER

TECHNICAL FIELD

The present disclosure relates to a refillable cosmetic container to which an inner container containing cosmetic contents such as a cream is coupled to be refillable. More particularly, the present disclosure relates to a push-type refillable cosmetic container, which allows an inner container to be simply separated by a gap formed as a second side of the inner container is lifted upward from an outer container by the push operation of downwardly pushing a first side of the inner container inserted into an upper portion of the outer container.

BACKGROUND ART

Generally, a cosmetic container is configured such that an upper cap is coupled to an upper portion of a container body accommodating cosmetic contents to be openable or closable.

After all the cosmetic contents in such a conventional cosmetic container are used up, a user should discard the entire cosmetic container and then repurchase and use a new cosmetic container.

Such a conventional cosmetic container is problematic in that a consumer purchases and uses a new cosmetic container every time, even when the same cosmetic contents are stored in the same cosmetic container to be used, so it is uneconomical and the used cosmetic container is discarded without being recycled, thus causing environmental pollution due to an increase in industrial waste.

In order to solve the problem, various types of refillable cosmetic containers have been recently proposed, in which the container body is separated into an outer container and an inner container accommodating cosmetic contents, so the inner container is inserted into and assembled with the outer container. Thus, after all the cosmetic contents of the inner container are used up, the inner container is separated from the outer container and only the inner container is newly replaced and coupled, thus allowing the outer container to be repeatedly used.

However, the above-described conventional refillable cosmetic container is problematic in that a coupling part provided on an outside of an upper portion of the inner container is fitted over a stepped part provided on an outside of an upper portion of the outer container, and the inner container and the outer container are coupled to each other through interference fitting and coupling protrusions of the inner and outer containers engage with each other to prevent the inner container from being unexpectedly separated when in use, so it is difficult to widen a space between the inner container and the outer container after the cosmetic contents are used up, thus it is not easy to separate the inner container.

In order to solve the problem, there has been proposed a method in which separate lock means are provided on the inner container and the outer container to couple and lock the inner container to the outer container and the inner container is separated from the outer container after the locking means are released. However, this is problematic in that the lock structure is complicated, so the manufacturing cost of the cosmetic container is increased and productivity is reduced, and it is also complicated to operate the lock means, so usability is greatly deteriorated and thereby this method cannot be applied to an actual product.

DISCLOSURE

Technical Problem

The present disclosure has been made to solve the above-mentioned problems and difficulties and relates to a push-type refillable cosmetic container, which allows an inner container to be simply separated by a gap formed as a second side of the inner container is lifted upward from an outer container by the push operation of downwardly pushing an upper portion of a first side of the inner container inserted into an upper portion of the outer container, thus making it convenient to refill and use the container.

Technical Solution

In order to accomplish the above objective, the present disclosure provides a push-type refillable cosmetic container, including an outer container, an inner container configured such that a storage part storing cosmetic contents is inserted into an insert space of the outer container and a coupling part formed on an upper edge thereof is fitted over a stepped part of an upper edge of the outer container, and an upper cap coupled to an outside of an upper portion of the outer container, wherein a press groove is formed on a first side of the stepped part of the outer container to be recessed downward and have a press gap that is spaced apart from the coupling part of the inner container, so, as the press groove of the outer container is pushed by a distance corresponding to the press gap on a first side of an upper portion of the inner container, an upper portion of a second side of the inner container is lifted upward from the outer container, thus forming a gap, and thereby the inner container is separated from the outer container using the gap.

According to the present disclosure, a spaced part may be formed between the storage part of the inner container and the insert space of the outer container to define a space therebetween and thereby allow the storage part to be tilted during a push-down operation on the first side of the upper portion of the inner container, and the press groove may include an upper press groove and a lower press groove of the outer container formed in a stepped structure to push a groove part formed on an inside of the coupling part of the inner container and a wall part formed on an outside thereof.

According to the present disclosure, the press groove of the outer container may be formed on a circumference of the inner container in a range of 90 to 120° or less.

Advantageous Effects

According to the present disclosure, the inner container is inserted into the outer container so that the coupling part provided on the upper portion of the inner container is coupled to the stepped part provided on the upper portion of the outer container, and the press groove is formed on the first side of the stepped part of the outer container to be recessed downward, so the inner container can be simply separated by the gap foamed as the upper portion of the second side of the inner container is lifted upward from the outer container by the push operation of downwardly pushing the press groove of the outer container on the first side of the upper portion of the inner container, thus making it convenient to refill and use the inner container.

MODE FOR INVENTION

Hereinafter, a preferred embodiment of the present disclosure will be described in detail with reference to the accompanying drawings.

Figure 1:
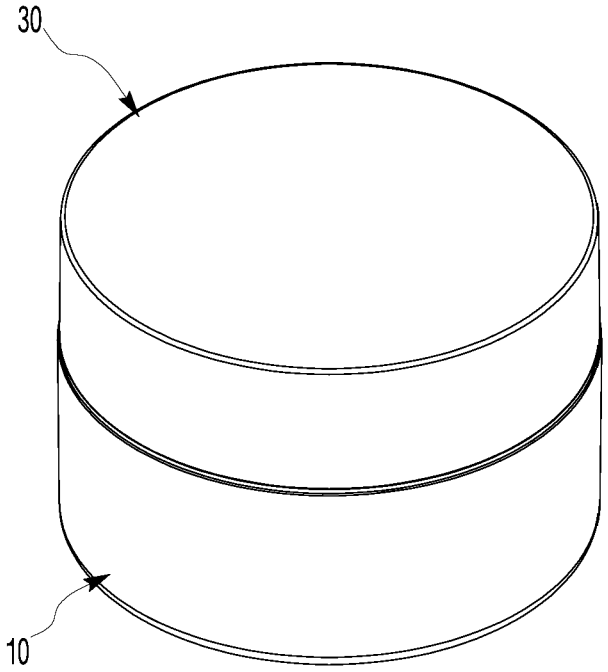
FIG. 1 is an external perspective view illustrating a cosmetic container according to the present disclosure.
Figure 2:
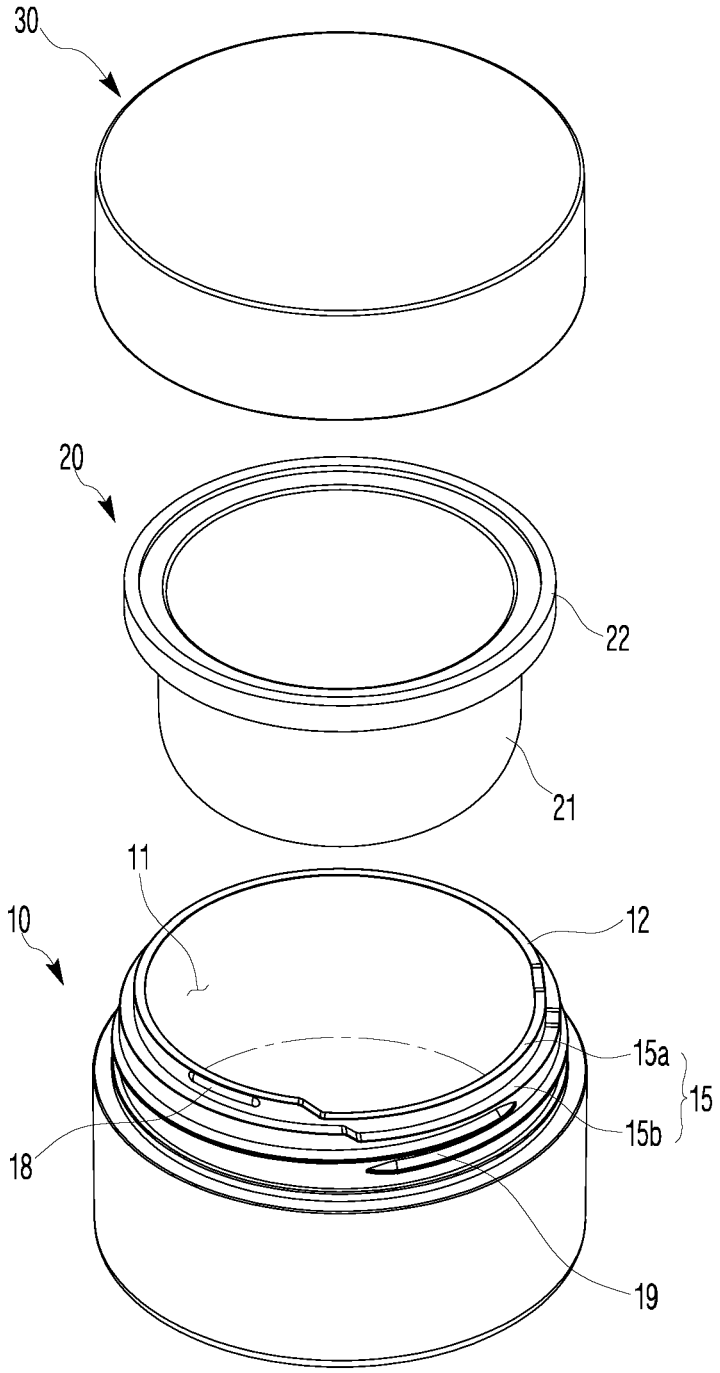
FIG. 2 is an exploded perspective view of FIG. 1.
Figure 3:
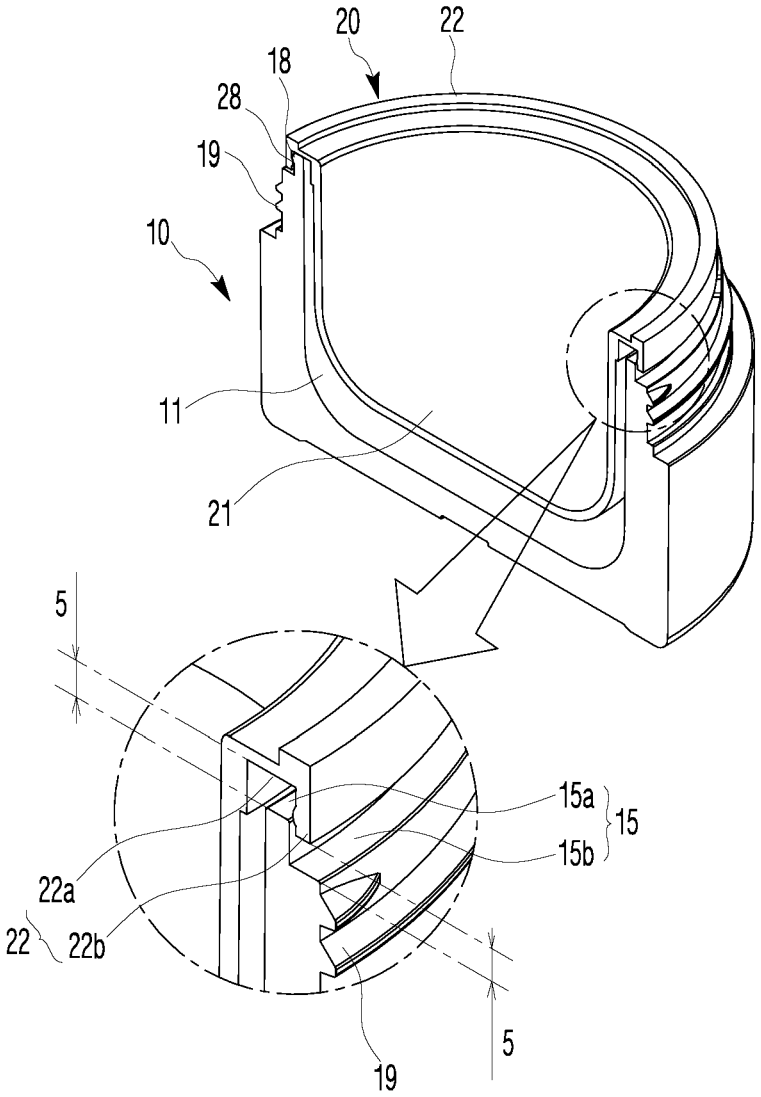
FIG. 3 is a half-sectional perspective view of FIG. 1.
Figure 4:
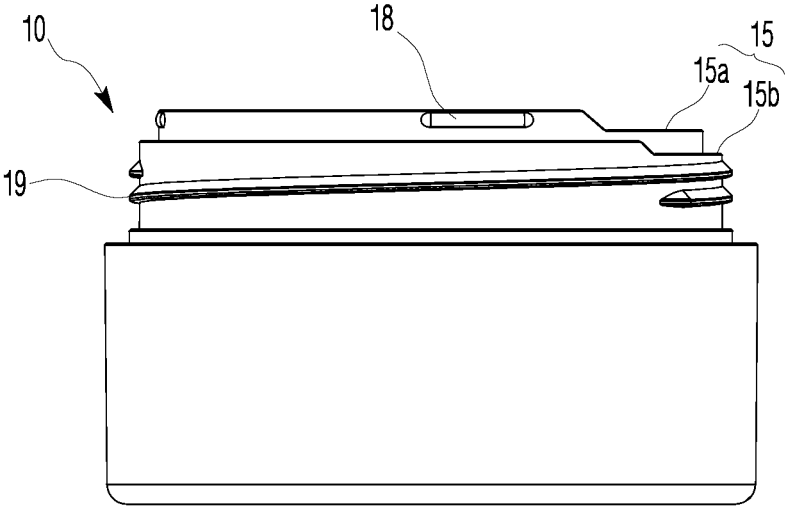
FIG. 4 is a front view illustrating an outer container according to the present disclosure.
Figure 5:
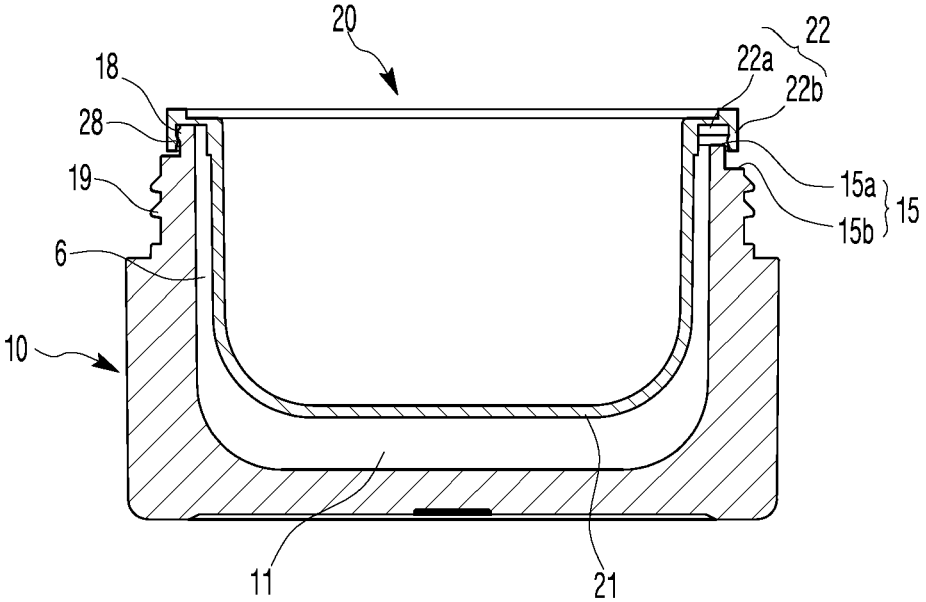
FIG. 5 is a front sectional view illustrating the cosmetic container according to the present disclosure.
Figure 6:
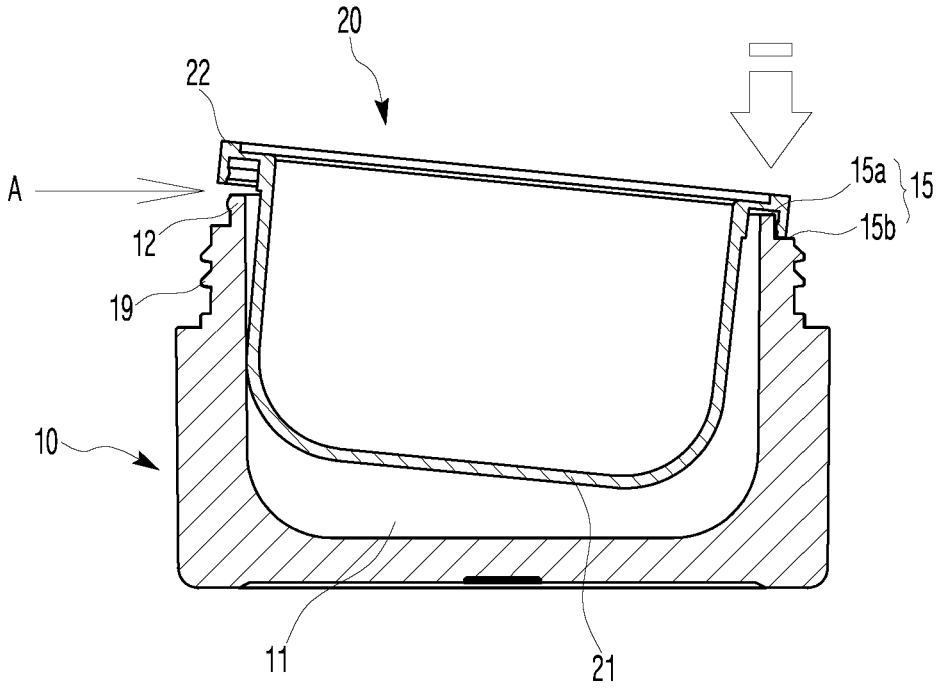
FIGS. 6 and 7 are front sectional views illustrating the operation of separating an inner container from FIG. 5.
Figure 7:
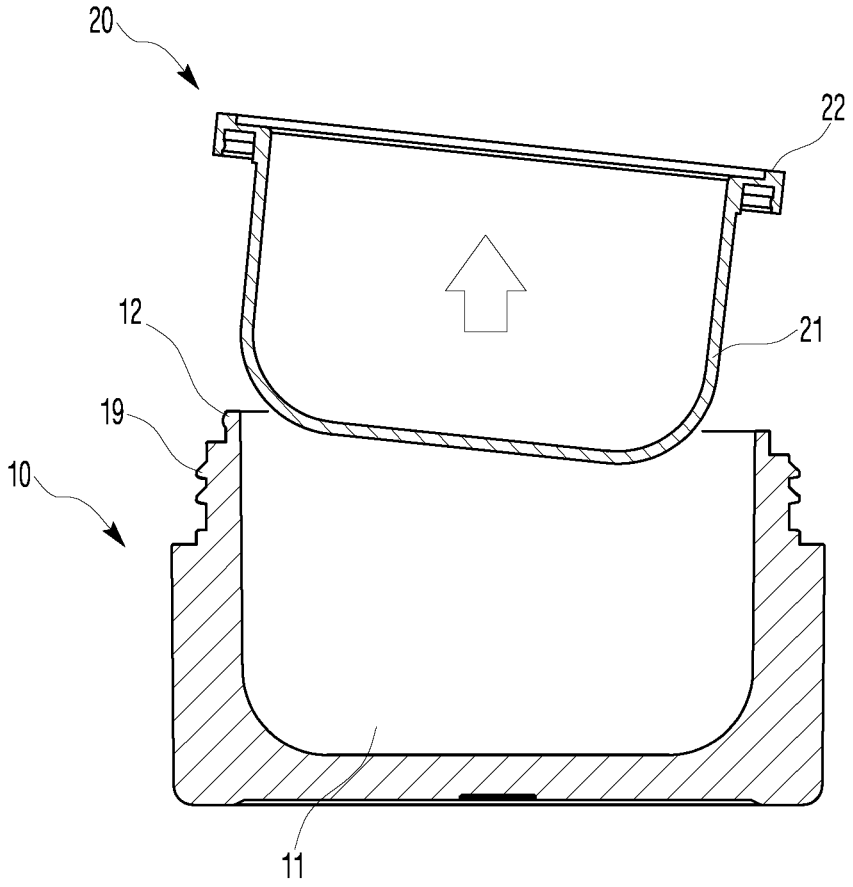

As illustrated in FIGS. 1 to 7, a push-type refillable cosmetic container according to the present disclosure includes an outer container 10, an inner container 20, and an upper cap 30, and is configured to be refillable by simply separating the inner container 20 from the outer container 10.

The outer container 10 is configured such that an insert space 11 is defined therein and a stepped part 12 is formed on an upper edge thereof.

The inner container 20 includes a storage part 21 that stores cosmetic contents and a coupling part 22 that is formed on an upper edge thereof, so that the storage part 21 is inserted into the insert space 11 of the outer container, and the coupling part 22 of the upper edge is fitted over the stepped part 12 of the upper edge of the outer container.

In particular, a press groove 15 is formed on a first side of the stepped part 12 of the outer container to be recessed downward and have a press gap 5 that is spaced apart from the coupling part 22 of the inner container. Thereby, as the press groove 15 of the outer container is pushed by a distance corresponding to the press gap 5 on the first side of the upper portion of the inner container 20, an upper portion of the second side of the inner container 20 is lifted upward from the outer container 10, thus forming a gap. The inner container is separated from the outer container using the gap.

At this time, a spaced part 6 is formed between the storage part 21 of the inner container and the insert space 11 of the outer container to define a space therebetween and thereby allow the storage part 21 to be tilted during a push-down operation on the first side of the upper portion of the inner container.

The press groove 15 includes an upper press groove 15*a* and a lower press groove 15*b* of the outer container formed in a stepped structure to push a groove part 22*a* formed on the inside of the coupling part of the inner container and a wall part 22*b* formed on the outside thereof.

Furthermore, the press groove 15 of the outer container is preferably formed in the range of 90 to 120° on the circumference of the outer container. When the range of the press groove 15 is formed too wide, coupling strength between the inner container and the outer container is reduced. When the range of the press groove is formed too narrow, the separating operation for lifting the second side of the inner container by the push operation of the inner container is not smoothly performed.

In addition, the upper cap 30 is configured to be coupled to the outside of the upper portion of the outer container in a screw-type fastening method or the like.

Reference numeral 18 denotes a locking protrusion that is formed on the outside of the upper portion of the stepped part of the outer container to protrude in a circumferential shape and fixedly engages with a support protrusion 28 of the inner container when the inner container is coupled to the outer container, and reference numeral 19 denotes a threaded part.

Next, the operation and effects of the present disclosure configured as such will be described.

First, the process of inserting the inner container 20 into the outer container 10 will be described. The storage part 21 of the inner container is inserted into the insert space 11 of the outer container, and the coupling part 22 on the upper edge of the inner container is fitted over the stepped part 12 on the upper edge of the outer container.

In this case, the support protrusion 28 formed on the coupling part 22 of the inner container engages with the locking protrusion 18 formed on the stepped part 12 of the outer container, so the inner container is coupled to the outer container so as not to be removed therefrom.

In this state, the upper cap 40 is coupled to the outside of the upper portion of the inner container in a screw-type fastening method.

The cosmetic container is used by coupling the upper cap in this manner. After the cosmetic contents stored in the storage part 21 of the inner container 20 are used up, the inner container 20 is simply separated from the outer container 10 and then is replaced with a refillable inner container.

The process of simply separating the inner container 20 from the outer container 10 will be described. The push operation of downwardly pressing the press groove 15 of the outer container on the first side of the upper portion of the inner container 20 is performed.

If the first side of the upper portion of the inner container 20 is pushed as such, the inner container is pushed by a distance corresponding to the press gap 5 that is formed between the coupling part 22 of the inner container and the press groove 15 of the outer container.

In other words, the groove part 22*a* formed on the inside of the coupling part of the inner container and the wall part 22*b* formed on the outside thereof are pushed by a distance corresponding to the press groove 5 between the upper press groove 15*a* and the lower press groove 15*b* formed on the stepped part 15 of the outer container.

As such, by the push operation in which the first side of the upper portion of the inner container 20 is pushed by a distance corresponding to the press gap 5, the upper portion of the second side of the inner container 20 is lifted upward, thus defining a gap A between the outer container and the inner container.

At this time, the spaced part 6 is formed between the storage part 21 of the inner container and the insert space 22 of the outer container, so the inner container is tilted by the push operation of pushing the first side of the upper portion of the inner container, and thereby the upper portion of the second side of the inner container is smoothly lifted upward.

Since a user inserts his or her finger into the gap A formed between the outer container 10 and the inner container 20 and lifts the inner container 20 upward, the inner container 20 can be simply separated from the outer container 10. Furthermore, after the inner container is separated, a new inner container is re-assembled and refilled.

Therefore, according to the present disclosure, the inner container is inserted into the outer container so that the coupling part 22 provided on the upper portion of the inner container 20 is coupled to the stepped part 12 provided on the upper portion of the outer container 10, and the press groove 15 is formed on the first side of the stepped part 12 of the outer container to be recessed downward, so the inner container can be simply separated by the gap formed as the upper portion of the second side of the inner container 20 is lifted upward from the outer container by the push operation of downwardly pushing the press groove 15 of the outer container on the first side of the upper portion of the inner container 20, thus making it convenient to refill and use the inner container.

The invention claimed is:

1. A push-type refillable cosmetic container, comprising:

an outer container (10) including an insert space (11) and a stepped part (12) located on an upper edge of the outer container (10) and provided with a press groove (15);

an inner container (20) including a storage part (21) storing cosmetic contents and being inserted into the insert space (11) of the outer container, and a coupling part (22) formed on an upper edge of the inner container (20) and being fitted over the stepped part (12) of the outer container; and an upper cap (30) coupled to an outside of an upper portion of the outer container, wherein the press groove (15) is formed on a first side of the stepped part (12) of the outer container to be recessed downward to form a press gap (5) between the stepped part (12) of the outer container and the coupling part (22) of the inner container, so, as a first side of the coupling part (22) located above the press groove (15) of the outer container is pushed down, a second side of the coupling part (22) is lifted upward from the outer container (10), thus forming a gap between the second side of the coupling part (22) and the outer container (10) to allow a user to separate the inner container (20) from the outer container (10) using the gap.

2. The push-type refillable cosmetic container of claim 1, wherein a spaced part (6) is formed between the storage part (21) of the inner container and the insert space (11) of the outer container to define a space therebetween and thereby allow the storage part (21) to be tilted during a push-down operation on the first side of the inner container, and the press groove (15) comprises an upper press groove (15*a*) and a lower press groove (15*b*) of the outer container formed in a stepped structure to push a groove part (22*a*) formed on an inside of the coupling part of the inner container and a wall part (22*b*) formed on an outside thereof.

3. The push-type refillable cosmetic container of claim 1, wherein the press groove (15) of the outer container is formed on a circumference of the inner container in a range of 90° to 120°.

4. The push-type refillable cosmetic container of claim 2, wherein the press groove (15) of the outer container is formed on a circumference of the inner container in a range of 90° to 120°.

* * * * *